US005299713A

United States Patent [19]

Saitoh

[11] Patent Number: 5,299,713

[45] Date of Patent: Apr. 5, 1994

[54] AUTOMATIC LIQUID SOAP SUPPLY DEVICE

[75] Inventor: Shiro Saitoh, Aichi, Japan

[73] Assignee: Inax Corporation, Tokoname, Japan

[21] Appl. No.: 945,910

[22] Filed: Sep. 17, 1992

[30] Foreign Application Priority Data

Sep. 24, 1991 [JP] Japan ..... 3-085823

[51] Int. Cl.[5] ..... B67D 5/22

[52] U.S. Cl. ..... 222/51; 222/63; 222/66; 222/255; 222/265

[58] Field of Search ..... 4/623, 628, 605, 638; 222/51, 63, 66, 642, 255, 263, 265, 266, 279, 330, 252

[56] References Cited

U.S. PATENT DOCUMENTS

| | | | |
|---|---|---|---|
| 1,117,238 | 11/1914 | Pollard | 4/628 |
| 2,446,109 | 7/1948 | Scarry | 222/63 |
| 4,235,352 | 11/1980 | Newman et al. | 222/255 X |
| 4,606,085 | 8/1986 | Davies | 4/623 |
| 4,682,710 | 7/1987 | Turner, Jr. et al. | 222/263 X |
| 4,914,758 | 4/1990 | Shaw | 4/623 X |
| 4,938,384 | 7/1990 | Pilolla et al. | 222/63 X |
| 4,989,755 | 2/1991 | Shiau | 222/642 X |
| 5,031,258 | 7/1991 | Shaw | 4/623 |
| 5,217,035 | 6/1993 | Van Marcke | 4/623 X |

FOREIGN PATENT DOCUMENTS

| | | | |
|---|---|---|---|
| 2024788 | 3/1991 | Canada . | |
| 1064436 | 8/1959 | Fed. Rep. of Germany | 4/623 |
| 4029462 | 3/1991 | Fed. Rep. of Germany . | |
| 2502482 | 10/1982 | France . | |
| 659310 | 10/1951 | United Kingdom | 222/278 |
| 2217688 | 11/1989 | United Kingdom | 222/330 |

*Primary Examiner*—Andres Kashnikow
*Assistant Examiner*—Kenneth Bomberg
*Attorney, Agent, or Firm*—Kanesaka & Takeuchi

[57] ABSTRACT

An automatic liquid soap supply device is formed of: a plurality of sub-units each having a use detection circuit for detecting the use of a liquid soap supply tap and a pump driving circuit connected with the use detection circuit, pumps each disposed to each of the sub-units, connected to each of the pump driving circuits for supplying a liquid soap to each of the supply taps and a main unit having a single power source circuit connected with each of the use detection circuits.

5 Claims, 7 Drawing Sheets

AUTOMATIC LIQUID SOAP SUPPLY DEVICE

BACKGROUND OF THE INVENTION AND RELATED ART STATEMENT

The present invention concerns an automatic liquid soap supply device for use in automatic supply of liquid soap to a plurality of water supply taps.

In a washing stand, for example, of a public lavatory, there are disposed a plurality of water discharging taps for supplying hand washing warmed water, as well as supply taps corresponding to the number of the water discharging taps for supplying liquid soap.

By the way, as a structure for supplying the liquid soap to each of the supply taps, an individual supply structure or a gravitational supply structure has been used generally. In the individual supply structure, reservoirs for storing liquid soap are disposed corresponding respectively to the supply taps and liquid soap is supplied from each of the reservoirs to each of the supply taps. However, in the individual supply structure, since the liquid soap has to be supplemented to each of the reservoirs, administration is complicated. In view of the above, in the gravitational structure, a single reservoir for storing a liquid soap is disposed above each of the supply taps, so that the liquid soap is distributed by weight of the soap in the reservoir to each of the supply taps. However, it is extremely difficult for a worker to supplement the liquid soap in each reservoir of this structure.

Then, a pressurized type automatic liquid soap supply device as shown in FIG. 7 has been proposed in view of the difficulty in the gravitational structure. The device comprises a single main reservoir 100 and a plurality of auxiliary reservoirs 104, 105 and 106 connected to the main reservoir 100 and corresponding to each of the supply taps 101, 102 and 103, in which each of the auxiliary reservoirs 104, 105 and 106 is connected by way of each of solenoid pumps 107, 108 and 109 to each of the supply taps 101, 102 and 103. Further, touch switches 110, 111 and 112 are disposed in the vicinity of the supply taps 101, 102 and 103 respectively and each of the touch switches 110, 111 and 112 is connected to each of the control circuits 113, 114 and 115, and each of the control circuits 113, 114 and 115 is connected with each of the solenoid pumps 107, 108, 109.

Each of the control circuits 113, 114 and 115 and each of the solenoid pumps 107, 108 and 109 are separately driven by a power source individually and when one (or plurality of them) is supplied with electric power, each of the solenoid pumps 107 (108, 109) is driven by each of the control circuits 113 (114, 115) upon contact of a user on the touch switch 110 (111, 112), so that the liquid soap in each of the auxiliary reservoirs 104 (105, 106) is supplied by each of the solenoid pumps 107 (108, 109) from each of the supply taps 101 (102, 103).

According to this device, since each of the auxiliary reservoirs 104, 105 and 106 is always connected with the main reservoir 100, it may suffice to supplement the liquid soap only to the inside of the main reservoir 100 and since there is no requirement to dispose the main reservoir 100 at a high place, the operation for supplementing the liquid soap is facilitated.

However, the existent automatic liquid soap supply device as described above involves the following various problems. That is, in this device, since each of the control circuits 113, 114 and 115 and each of the solenoid pumps 107, 108 and 109 disposed corresponding to each of the supply taps 101, 102 and 103 are separately driven by a power source individually, connection plugs 116, 117 and 118 have to be disposed by the number corresponding to that of the supply taps 101, 102 and 103 in a public lavatory. Accordingly, this makes electric work troublesome and makes it difficult to shorten the necessary time upon installation. In addition, warmed water from a discharge tap (not illustrated) used by a user often splashes from a washing stand 119, 120 or 121 and a great amount of water is used for cleaning. Accordingly, there may be a risk of electric leakage in the device of this structure. Further, in a cold district or highly humid district or season, the device of the above-mentioned structure also causes a great risk of electric leakage in the lavatory. Accordingly, in the device having the above-mentioned structure, leakage proof countermeasure has to be taken corresponding to each of the supply taps 101, 102 and 103. Moreover, in the existent device as described above, although the supplement for the liquid soap is simplified, since supply and stop of the power source to each of the control circuits 113, 114 and 115 and each of the solenoid pumps 107, 108 and 109 can be conducted only when the connection is made or released between each of the plugs 116, 117 and 118 and each of individual power sources, the operation efficiency, for example, upon cleaning is worsened.

OBJECT AND SUMMARY OF THE INVENTION

The present invention is proposed for solving the foregoing problems in the existent automatic liquid soap supply device as described above and it is an object thereof to provide an automatic liquid soap supply device capable of simplifying electric work and shortening the construction time upon installation, free from the risk of electric leakage and, further, enabling of rapid cleaning operation.

The present invention has been proposed for attaining the foregoing object and the first invention comprises a plurality of sub-units each having a use detection circuit for detecting the use of a supply tap that discharges a liquid soap and a pump driving circuit connected with the use detection circuit, pumps connected to the pump driving circuits respectively for supplying the liquid soap to each of the supply taps, and a main unit having a single power source circuit connected with each of the use detection circuits.

A second invention comprises a plurality of sub-units each having a use detection circuit for detecting the use of a supply tap that discharges a liquid soap and a pump driving circuit connected with the use detection circuit, a pump connected to the pump driving circuits respectively for supplying the liquid soap to each of the supply taps, a main unit having a single power source circuit and a control circuit connected to each of the use detection circuits and a level detection circuit connected to the control circuit for detecting the level of the liquid soap in a reservoir that stores the liquid soap.

The third invention comprises a plurality of sub-units each having a use detection circuit for detecting the use of a supply tap that discharges the liquid soap and a pump driving circuit connected with the use detection circuit, a main unit having a single power source circuit connected with each of the use detection circuits and a single pump connected with each of the pump driving circuits for supplying the liquid soap to each of the supply taps.

The fourth invention comprises a plurality of sub-units each having a use detection circuit for detecting the use of a supply tap that discharges the liquid soap and a pump driving circuit connected with the use detection circuit, a main unit having a single power source and a control circuit connected with each of the use detection circuits, a single pump connected to each of the pump driving circuits for supplying the liquid soap to each of the supply taps and a level detection circuit connected with the control circuit for detecting the level of the liquid soap in a reservoir that stores the liquid soap.

In the automatic liquid soap supply device according to the present invention, when one or more of the supply taps disposed in plurality is used, the use detection circuit connected with the single power source circuit constituting the main unit and constituting each of the sub-units is actuated, the pump driving circuit is further actuated by the actuation of the use detection circuit, and the liquid soap is discharged from the supply tap under the driving of the pump. Accordingly, with the automatic liquid soap supply device of this constitution, since the respective use detection circuits and the pump driving circuits constituting the respective sub-units are connected to the single power source circuit, it may suffice to merely connect a connection terminal for the sub-unit with a connection terminal for the main unit upon installation of the device in a lavatory, which makes electric work extremely simple and rapid and can effectively avoid the risk of electric leakage. Further, since all of the use detection circuits and the pump driving circuits constituting the sub-units are turned off by merely turning the single power source to off, operation efficiency upon cleaning can be improved as well.

In particular, in the second and the fourth inventions, since the level detection circuit for detecting the level of the liquid slap in each of the reservoirs is disposed, a worker can rapidly supplement the liquid soap when the liquid soap in the reservoir lowers to a predetermined level.

DETAILED DESCRIPTION OF THE PREFERRED EMBODIMENTS

At first, description will be made to an automatic liquid soap supply device according to the first embodiment.

Figure 1:
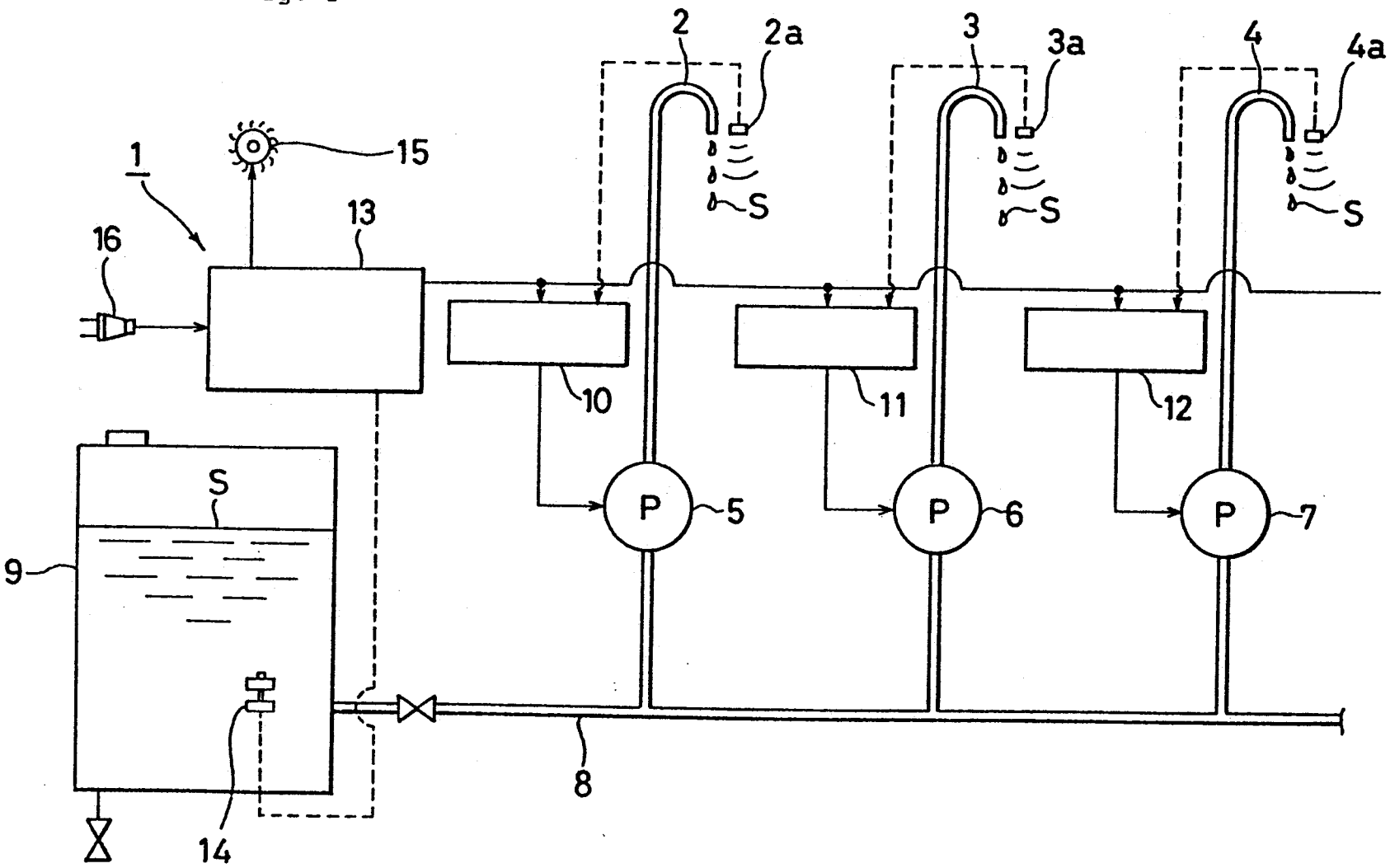
FIG. 1 is a schematic view illustrating the constitution of an automatic liquid soap supply device according to the first embodiment of the present invention.

An automatic liquid soap supply device according to this embodiment mainly comprises, as shown in FIG. 1, a plurality of supply taps 2, 3 and 4 for supplying a liquid soap, pumps 5, 6 and 7 connected to the supply taps 2, 3 and 4 respectively, a reservoir 9 connected by way of a pipe 8 to the pumps 5, 6 and 7, for storing liquid soap (or water soap) S, sub-units 10, 11 and 12 connected with the pumps 5, 6 and 7 respectively, and a main unit 13 connected with each of the sub-units 10, 11 and 12. In this embodiment, sensors 2*a*, 3*a* and 4*a* are disposed, respectively, to the supply taps 2, 3 and 4, for detecting the use of the supply taps 2, 3 and 4, and the sensors 2*a*, 3*a* and 4*a* are connected, respectively, to the sub-units 10, 11 and 12. In this embodiment, each of the pumps 5, 6 and 7 is adapted to actuate only for a predetermined period of time. Further, a level switch 14 is disposed in the reservoir 9 that stores the liquid soap (or water soap) S. Further, a level indication lamp 15 is connected with the main unit 13, and it is adapted to light-up upon detection of the level of the liquid soap S by the level switch 14 disposed in the reservoir 9 to be described later.

Figure 2:
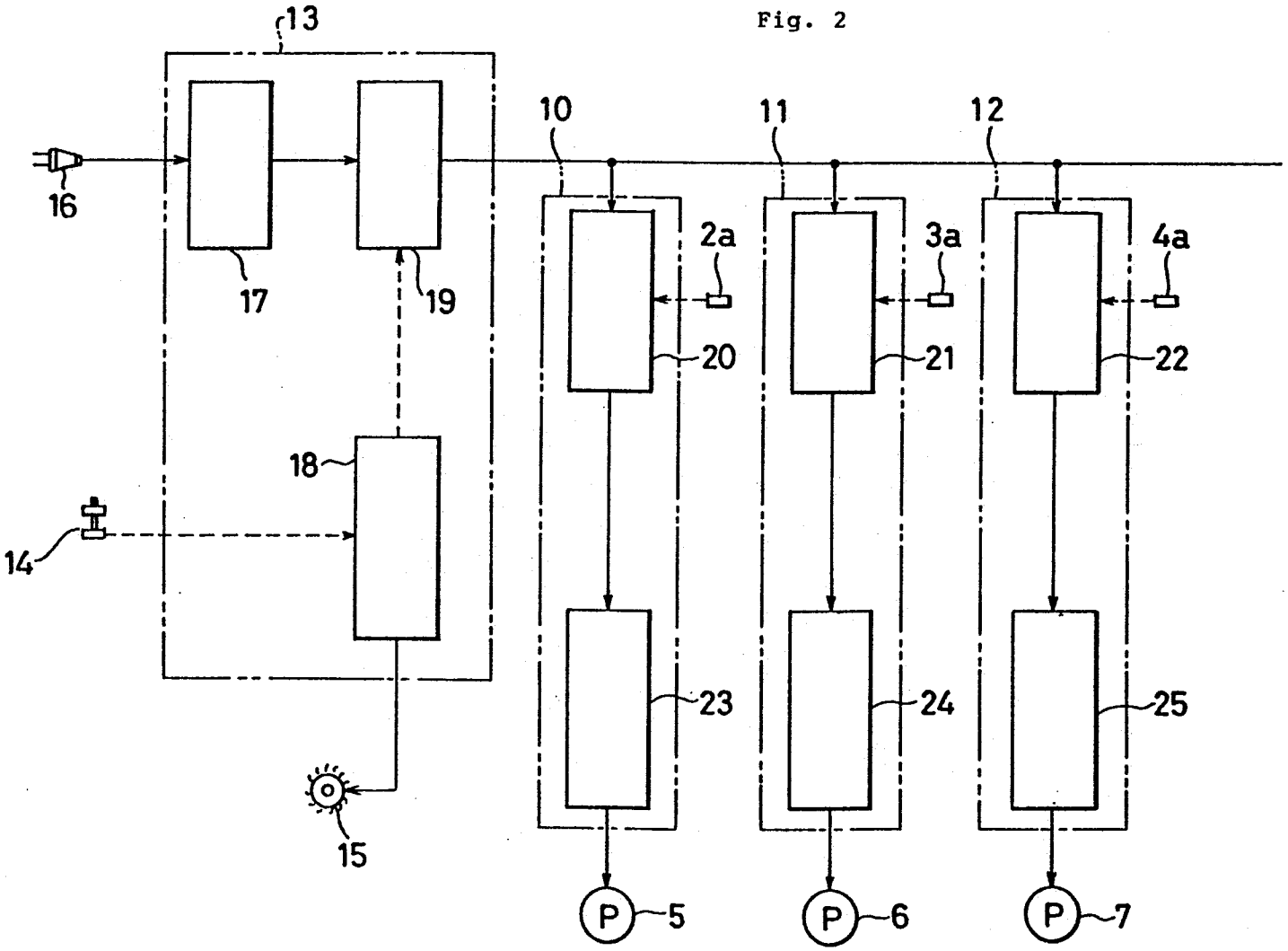
FIG. 2 is a block diagram for the automatic liquid soap supply device shown in FIG. 1.

As shown in FIG. 2, the main unit 13 comprises a power source circuit 17 connected with a plug 16, a level detection circuit 18 disposed in the reservoir 9 and connected with the level switch 14 and a control circuit 19 connected with the level detection circuit 18 and also with the power source circuit 17.

Each of the sub-units 10, 11 and 12 is connected with each of the sensors 2*a*, 3*a* and 4*a* disposed to each of the supply taps 2, 3 and 4, and comprises each of use detection circuits 20, 21 and 22 supplied with electric power from the control circuit 19 in the main unit 13 and each of pump driving circuits 23, 24 and 25 connected with each of the pumps 5, 6 and 7 shown in FIG. 1.

Figure 3:
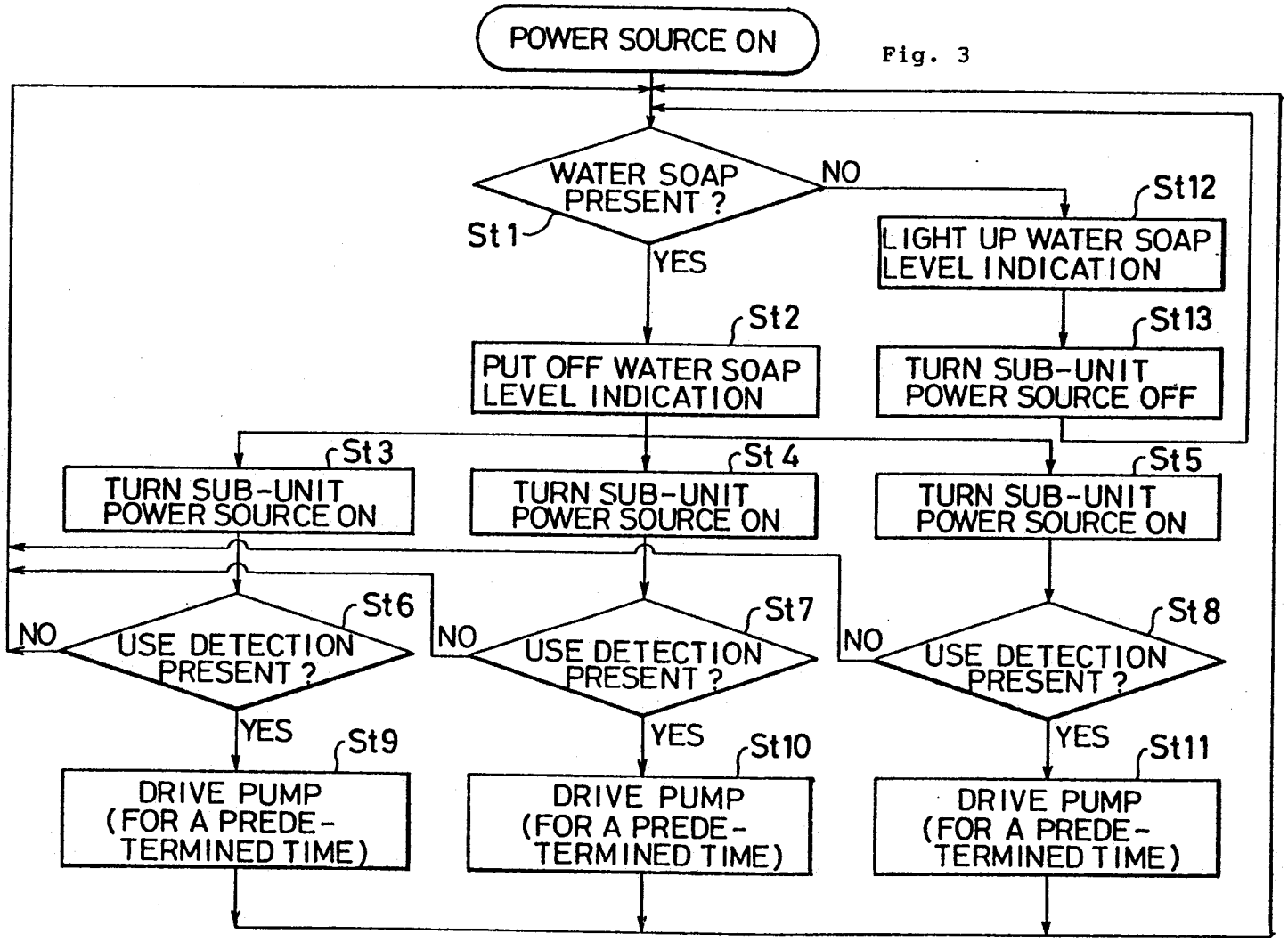
FIG. 3 is a flow chart for the automatic liquid soap supply device shown in FIG. 1.

Description will be made to the operation of the automatic liquid soap supply device 1 having the constitution as described above with reference to the flow chart shown in FIG. 3.

At first, when the device is connected with a power source by the plug 16, it is detected at step st1 as to whether the liquid soap S in the reservoir 9 is at a predetermined level or not. The detection is conducted by the level detection circuit 18 constituting the main unit 13 by way of the level switch 14 disposed in the reservoir 9. Then, if it is judged that the liquid soap is at a predetermined level by the level detection circuit 18, the flow goes to step st2. At the step st2, the level indication lamp 15 connected with the level detection circuit 18 is put off based on an output signal from the control circuit 19 connected with the level detection circuit 18 and the flow goes to step st3, step st4 and step st5. At each of the step st3, step st4 and step st5, the electric power from the power source circuit 17 is supplied by way of control circuit 19 to each of the sub-units 10, 11 and 12 and then the flow goes to step st6, step st7 and step st8.

At each of the step st6, step st7 and step st8, it is detected by each of the use detection circuits 20, 21 and 22 as to whether each of the supply taps 2, 3 and 4 is used or not. That is, when a user brings his hand closer to any one of the water supply taps 2, 3 and 4 for using the same, the use detection circuit 20 (21, 22) connected with the sensor 2*a* (3*a*, 4*a*) detects the use of the supply tap 2 (3, 4) by way of the corresponding sensor 2*a* (3*a*, 4*a*) and then the flow goes to step st9, step st10 and step st11, respectively.

At the step st9, step st10 and step st11, each of the pump driving circuits 23, 24 and 25 connected with each of the use detection circuits 20, 21 and 22 drives each of the corresponding pumps 5, 6 and 7 for a predetermined period of time. Upon driving of the pump 5, 6 or 7, the liquid soap S in the reservoir 9 is supplied by way of the pipe 8 to water supply tap 2, 3 or 4.

Subsequently, the flow returns from the step 9, 10 and 11 to the step st1. If the use of the supply tap 2, 3 or 4 is not detected in each of the step st6, step st7 and step st8, the flow returns again to the step st1.

Then, when the liquid soap S in the reservoir 9 is gradually decreased while the operations from the step st1 to the step st9, step st10 and the step st11 are conducted continuously and the liquid soap S is supplied from each of the supply taps 2, 3 and 4 and, as a result, when the level switch 14 is actuated to detect that the liquid soap S is no more present by the level detection circuit 18, the flow goes from the step st11 to a step st12.

At the step st12, the level indication lamp 15 connected with the control circuit 19, which receives a signal output from the level detection circuit 18, is light-up to inform that the liquid soap S in the reservoir 10 does not reach a predetermined level and the flow further goes to a step st13.

At the step st13, power source supplied so far from the power source circuit 17 to each of the sub-units 10, 11 and 12 is stopped and the flow returns again to the step st1.

In the automatic liquid soap supply device 1 according to the first embodiment as described above, each of the use detection circuits 20, 21 and 22 and each of the pump driving circuits 23, 24 and 25 constituting each of the sub-units 10, 11 and 12 are supplied with electric power respectively from the single power source circuit constituting the main unit 13 and actuated by the power source based on the detection signal from each of the sensors 2*a*, 3*a* and 4*a*.

Accordingly, upon electric work in a case of installing the device 1 in a public lavatory or the like, it is not required to dispose power sources and plugs corresponding to each of the sub-units 10, 11 and 12 but it may suffice to merely connecting the power source to the connection terminal for the main unit 13 or the sub-unit 10, 11 or 12. This can improve the operation efficiency and shorten the necessary time for construction. In addition, when a supply tap is additionally provided and a sub-unit is added, the additional sub-unit requires no separate power source and, accordingly, it can be mounted extremely simply. Furthermore, in the device 1, since each of the sub-units 10, 11 and 12 has no individual power source, a risk of causing electric leakage from such individual power source can effectively be prevented in a public lavatory using a great amount of warmed water.

Further, in the automatic liquid soap supply device according to this embodiment, since the level switch 14, the level indication circuit 18 and the level indication lamp 15 are disposed and the switch for the level switch 14 is turned ON when the liquid soap S in the reservoir 9 is decreased to less than a certain level and the level indication lamp is lighted-up by way of the level detection circuit 18 and the control circuit 19, it can be judged simply whether it is necessary to supplement the liquid soap S or not.

Figure 4:
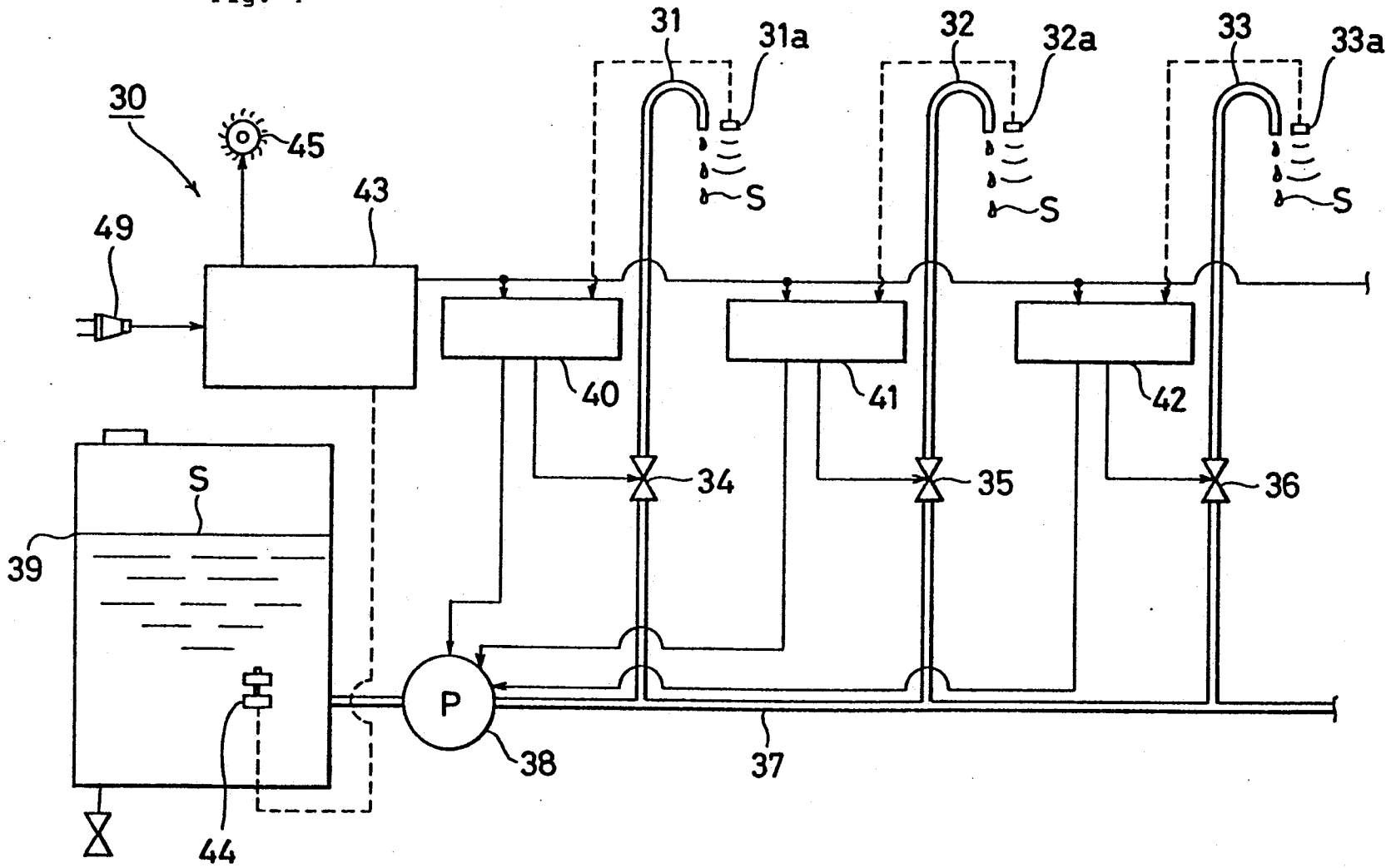
FIG. 4 is a schematic view illustrating the constitution of an automatic liquid soap supply device according to a second embodiment of the present invention.

Descriptions have been made to the automatic liquid soap supply device 1 according to the first embodiment to a case in which the pumps 5, 6 and 7 are disposed corresponding to the sub-units 10, 11 and 12 of the supply taps 2, 3 and 4, respectively, but a plurality of pumps are not always necessary in the automatic liquid soap supply device according to the present invention but a single pump may be used as in an automatic liquid soap supply device 30 shown in FIG. 4 as the second embodiment.

Description will now be made in details for the automatic liquid soap supply device 30 according to the second embodiment with reference to the drawings.

As shown in FIG. 4, the automatic liquid soap supply device 30 according to this embodiment mainly comprises a plurality of supply taps 31, 32 and 33, solenoid valves 34, 35 and 36 connected to the supply taps 31, 32 and 33, respectively, a single pump 38 connected by way of a pipe 37 to the solenoid valves 34, 35 and 36, a reservoir 39 connected with the pump 38 for storing a liquid soap S, sub-units 40, 41 and 42 connected, respectively, with the solenoid valves 34, 35 and 36 and with the pump 38, and a main unit 43 connected with the each of the sub-units 40, 41 and 42.

Also in the device 30 according to this embodiment, sensors 31*a*, 32*a* and 33*a*, a level switch 44, a level indication lamp 45 and a plug 49 having the same constitution as in the device 1 according to the first embodiment are also provided. Further, the main unit 43 also comprises, as shown in FIG. 5, a power source circuit 46, a control circuit 47 and a level detection circuit 48 in the same manner as in the automatic liquid soap supply device 1.

Figure 5:
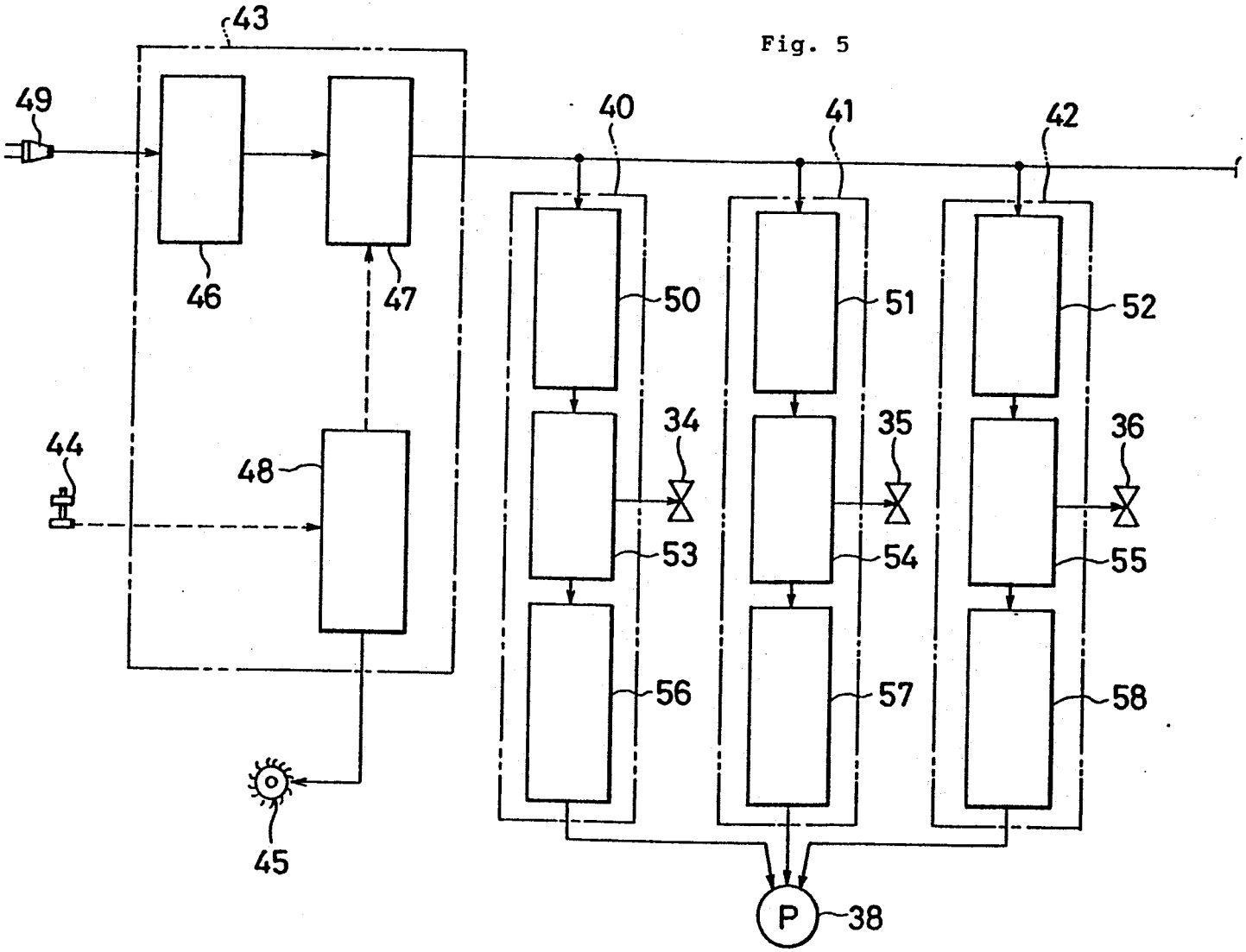
FIG. 5 is a block diagram for the automatic liquid soap supply device shown in FIG. 4.

Then in the device 30, as shown in FIG. 5, each of the sub-units 40, 41 and 42 comprises, as shown in FIG. 5, each of use detection circuits 50, 51 and 52 connected with each of sensors 31*a*, 32*a* and 33*a* disposed to each of supply taps 31, 32 and 33, each of valve control circuits 53, 54 and 55 connected with each of the use detection circuits 50, 51 and 52 and each of pump driving circuits 56, 57 and 58 connected with each of the valve control circuits 53, 54 and 55.

Figure 6:
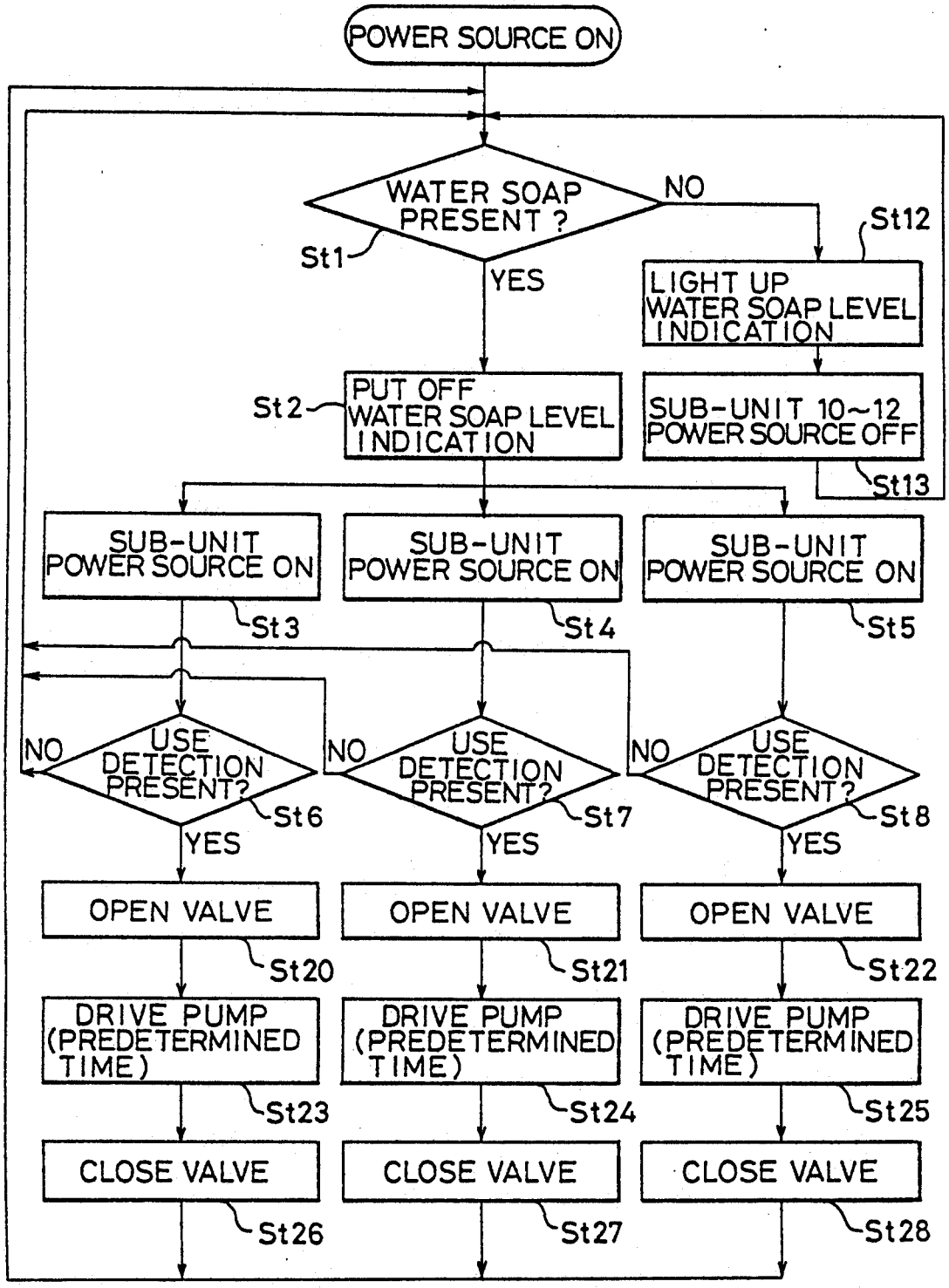
FIG. 6 is a flow chart for the automatic liquid soap supply device shown in FIG. 4.
Figure 7:
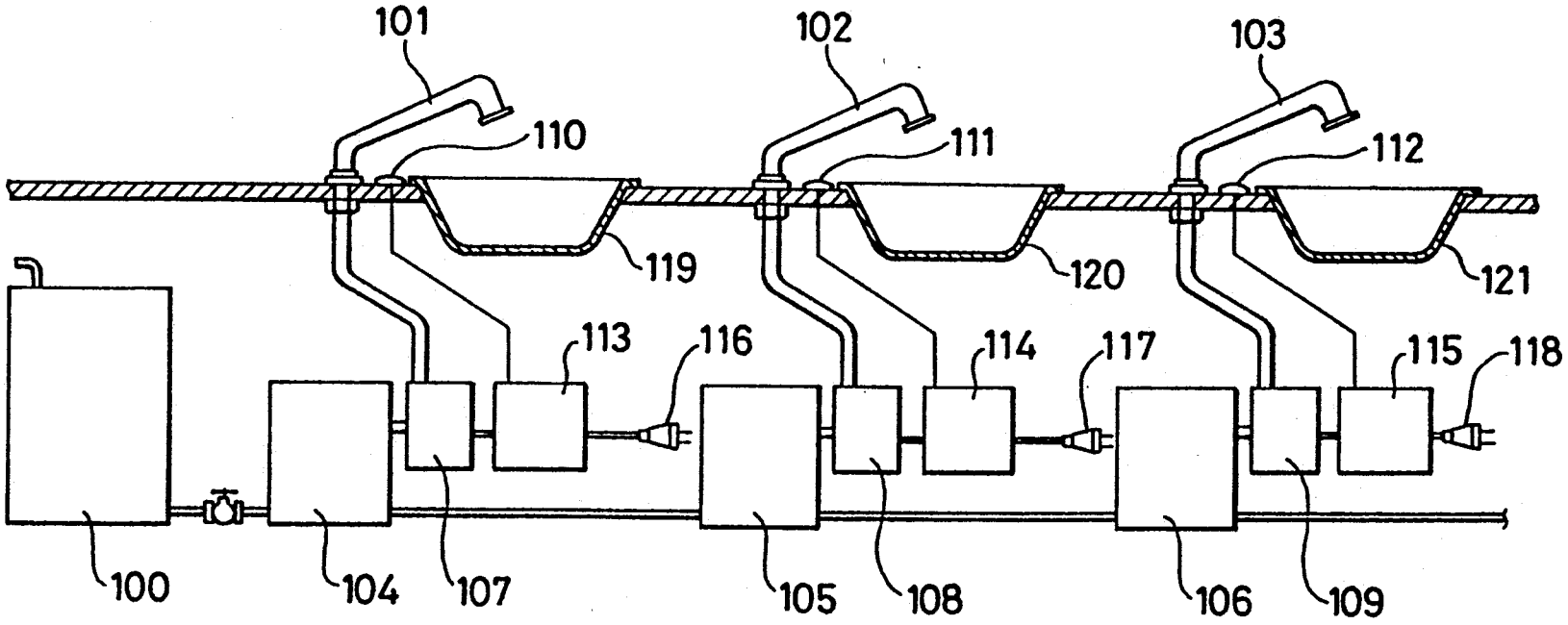
Fig. 7 Prior Art
FIG. 7 is a schematic view illustrating the constitution of an existent automatic liquid soap supply device.

Description will now be made to the operation of the automatic soap supply device 30 having the constitution as described above with reference to the flow chart shown in FIG. 6.

In the flow chart, all of the operations from a step st1 to step st6, step st7 and step st8, i.e., all of the operations from the state in which the power source is turned ON to the detection for the use of the supply tap 31, 32 or 33 by each of the use detection circuits 50, 51 and 52 are quite identical with those in the automatic soap supply device 1 according to the first embodiment as described above and, accordingly, duplicate explanation therefor will be omitted.

Then, in this device 30, the flow goes from the step st6, step st7 and step st8, respectively, to step st20, step st21 and step st22. In the step st20, step st21 and step st22, valve control circuits 53, 54 and 55 are actuated by the output signals from the use detection circuits 50, 51 and 52 to open each of the solenoid valves 34, 35 and 36 and then the flow goes to step st23, step st24 and step st25.

In the step st23, step 24 and step st25, the single pump 38 connected to the pump driving circuits 56, 57 and 58 is driven for a certain period of time by each of the pump driving circuits 56, 57 and 58 connected with the valve control circuits 53, 54 and 55, respectively, whereby the liquid soap S in the reservoir 39 is supplied by way of the pipe 37 to the water supply taps 31, 32 and 33 and then the flow goes to step st26, step st27 and step st28.

Then, in the step st26, step st27 and step st28, the solenoid valves 34, 35 and 36 opened in the step st20, step st21 and step st22 are closed by the solenoid valve control circuits 53, 54 and 55. Also in this embodiment, each of the operations from the step st1 to the step st12 or from the step st12 to the step st 13 is the same as the operation described for the first embodiment.

In the automatic liquid soap supply device 30 according to the second embodiment of the present invention described above, not only the same advantageous effects as those in the device 1 according to the first embodiment can be attained but also the cost can be reduced since the single pump 38 is disposed instead of disposing a plurality of such pumps corresponding to each of the sub-units 40, 41 and 42.

Further, although descriptions have been made to this illustrated embodiment in which the pump 38 is driven by connection with each of the sub-units 40, 41 and 42 having each of the pump driving circuits 56, 57 and 58, the pump may also be driven by connecting it with the main unit 43 connected with each of the sub-units 40, 41 and 42 and depending on the output signal from the control circuit 47 constituting the main unit 43.

Further, in the automatic liquid soap supply device 30 having the constitution as described above, the flow rate of the liquid soap S is changed in a case where the liquid soap S is supplied from a plurality of supply taps 31, 32 (33). That is, comparing the flow rate of the liquid soap S when it is supplied only from the first supply tap 31 and the flow rate of the liquid soap S when it is supplied from both of the first and second (or third) supply taps 31, 32 (33), the flow rate in the latter case is lower than that in the former case. Then, in order to make the flow rate of the liquid soap S issued from each of the supply taps always constant both in the case of using only one supply tap and in the case of using a plurality of supply taps, a flow rate control circuit (not illustrated) may be disposed in the main unit 43 for controlling the flow rate of the pump 38 and the driving force of the pump 38 may be changed by way of the flow rate control circuit depending on the output signal from the use detection circuit 50, 51 and 52 constituting the sub-units 40, 41 and 42.

Alternatively, a flow rate control circuit (not illustrated) connected with each of the pump driving circuit 56, 57 and 58 may be disposed in each of the individual sub-units 40, 41 and 42 and the flow rate of driving force may be controlled by connecting each of the flow rate control circuits with the pump 38.

Furthermore, although descriptions to the automatic liquid soap supply device 1, 30 according to each of the embodiments described above have been made to the illustrated structure in which the sensors are disposed to the supply taps to which the liquid soap S is supplied respectively, the automatic liquid soap supply device according to the present invention may have another constitution such as a touch switch instead of detecting the use of the supply tap by the sensor.

Further, the automatic liquid soap supply device 1, 30 according each of the embodiments described above comprises a level switch for detecting the level detection in a tank that stores the liquid soap and a level detection circuit for detecting the on-state of the level switch as the constituent factors, but they may not necessarily be disposed in the present invention. Further, although the automatic liquid soap supply device 1, 30 in each of the embodiments described above comprises three supply taps and three sub-units corresponding thereto as an illustrated embodiment, the number of the supply taps and the sub-units is not restricted only thereto.

As apparent from the descriptions to each of the embodiments of the present invention described above, in the automatic liquid soap supply device according to the present invention, when one or more of supply taps disposed in plurality is used, the use detection circuit connected with the single power source constituting the main unit and constituting each of the sub-units is actuated and, further, the pump driving circuit is actuated by the actuation of the use detection circuit and the liquid soap is discharged from the supply tap by the driving of the pump.

Accordingly, in the automatic liquid soap supply device having the constitution as described above, since the use detection circuit and the pump driving circuit constituting each of the sub-units are connected with the single power source circuit, it may suffice to merely connect a connection terminal for the sub-unit with a connection terminal for the main unit, in a case where the device is installed in a lavatory or the like, and the installation work can be conducted extremely simply and rapidly. In addition, the size of the sub-unit can be reduced and the danger of electric leakage can also be avoided effectively. Furthermore, since all of the operations for the use detection circuits and the pump driving circuits constituting the sub-unit are turned off by merely turning off the single power source, the operation efficiency can be improved also during cleaning. In addition, according to the present invention, in particular, in the second and the fourth inventions, the liquid soap in the reservoir can be observed easily by the level detection circuit to further improve the operation efficiency.

What is claimed is:

1. An automatic liquid soap supply device comprising:

a plurality of liquid soap supply taps to eject liquid soap, a plurality of sub-units associated with the respective liquid soap supply taps, each sub-unit having a sensor for sensing presence of a hand located under the liquid soap supply tap, a use detection circuit connected to the sensor and a pump driving circuit connected to and activated by said use detection circuit, a reservoir for storing the liquid soap to supply the liquid soap to the respective liquid soap supply taps, pumps disposed to the respective sub-units, each pump being connected to each pump driving circuit for supplying the liquid soap in the reservoir to each supply tap, and a main unit having a single power source circuit connected with each of said use detection circuits so that each pump is driven to supply the liquid soap to the liquid soap supply tap when the sensor detects the hand.

2. A device as defined in claim 1, further comprising a level detection circuit for detecting a level of the liquid soap in the reservoir so that each pump is actuated when said sensor detects the hand while said level detection circuit detects the level higher than a predetermined level.

3. A device as defined in claim 1, wherein a detection signal is inputted to the use detection circuit from the sensor when the hand put below the supply tap is detected.

4. A device as defined in claim 2, further comprising a level sensor disposed in the reservoir to provide a detection signal to the level detection circuit.

5. A device as defined in claim 2, further comprising an indication lamp which is lighted-up by the level detection circuit when the level of the liquid soap in the reservoir is below the predetermined level.

* * * * *